United States Patent [19]

Porter

[11] 4,012,933

[45] Mar. 22, 1977

[54] BENDING MACHINES

[75] Inventor: John Brian Porter, Newton Abbot, England

[73] Assignee: Russel Bowen Systems Ltd., Newton Abbot, England

[22] Filed: Sept. 4, 1975

[21] Appl. No.: 610,229

[30] Foreign Application Priority Data

Sept. 11, 1974 United Kingdom ..... 39612/74

[52] U.S. Cl. ..... 72/217

[51] Int. Cl.[2] ..... B21D 7/024

[58] Field of Search ..... 72/217, 218, 219, 149

[56] References Cited

UNITED STATES PATENTS

| | | | |
|---|---|---|---|
| 2,414,926 | 1/1947 | Burke | 72/217 |
| 2,510,183 | 6/1950 | Luce | 72/217 X |
| 2,956,609 | 10/1960 | Shaw, Jr. | 72/217 X |
| 3,438,237 | 4/1969 | Sisler | 72/217 X |
| 3,662,575 | 5/1972 | Zmuda | 72/21 |

*Primary Examiner*—Milton S. Mehr

*Attorney, Agent, or Firm*—Lowe, King, Price & Markva

[57] ABSTRACT

A bending machine having one or more bending units wherein a former device is movable to clamp a workpiece so that the workpiece can be bent by a bending arm and tool moved arcuately about the former device, and wherein the movement of the former device is reversible to free the bent workpiece from the bending unit.

16 Claims, 12 Drawing Figures

BENDING MACHINES

BACKGROUND OF THE INVENTION

The invention concerns bending machines, for bending tubular steel and like elongate workstock.

Bending machines are known wherein the workstock is supported across a pair of wing dies below a former which is moved towards and between the dies which move arcuately, against a resistance, as the former moves between them to bend the workstock. However in such machines the free end portions of the workstock are caused to swing or move through large angles during bending, which limits the usefulness of such machines.

Bending machines are also known in which the movement of the workstock is limited. Such machines generally comprise a former, a clamp device, a tool mounted on a bending arm, and mechanisms to cause a sequence of operations to bend the workstock. These mechanisms generally include at least a mechanism to actuate the clamp device to secure the workstock and move it towards the former, a mechanism for moving the tool towards the former to clamp the workstock therebetween, and a mechanism for moving the bending arm to cause the tool to move about the former to bend the workstock. Such machines are often costly, complex and relatively cumbersome, and involve repetitive movement of flexible hydraulic hoses required to supply power for actuating the tool.

SUMMARY OF THE INVENTION

An object of the invention is to provide an improved bending machine which can be made economically so as to be compact and relatively simple.

According to the invention, there is provided a bending unit comprising a former device, a bending means disposed on a rotatably mounted bending arm means, a clamp member, means for rotating the bending arm means about a fixed axis and carrier shaft means disposed coaxially with said fixed axis. Means connect the former device to the carrier shaft to move the former device between an open position and a bending position. In the open position, the former device is spaced apart from the bending means by an amount sufficient to allow movement of a workpiece therebetween. In the bending position, the former device is effective to thrust the workpiece against the bending means and clamp member. The bending arm is then rotated about a fixed axis to cause the bending means to bend the workpiece about the former device which is held static in the bending position.

In another feature of the invention, the former device connecting means includes eccentric means connecting the former device at the end of carrier shaft means. In a specific embodiment, the eccentric means includes a pin member securable in alternative sockets located in the carrier shaft means. This feature allows the former device, bending arm and bending arm rotating means to be adapted to operate for clamping and bending a workpiece in either a clockwise or an anticlockwise direction.

A further feature of the invention includes an actuating means effective to cause the rotating means to pivot the bending arm about the fixed axis when the former device is in the bending position. The actuating means may include a hydraulic circuit as described hereinbelow.

A further feature of the invention provides a bending machine having one or more of said bending units.

The former device is preferably provided with an extension which serves to clamp the workpiece against the clamp member.

A linkage is preferably provided further to control the movement of the former by the eccentric such that the former device is moved bodily in a curve between said open and bending positions without being rotated significantly about said axis or the axis of the eccentric.

A workpiece rest may be secured to the clamp member, which member may be adjustably mounted on the machine.

The linkage, former device, eccentric, bending arm and the tool may all be reversible or relocatable with respect to or on the machine. Thus, the machine may be operated so as to clamp and bend workstock in either a clockwise or anticlockwise manner.

The machine may be provided with two such units arranged to bend a workpiece in opposite directions, the formers being moved towards each other as they are moved to their open position, to allow removal of the workpiece after bending.

The machine may be hydraulically operated by means of a hydraulic circuit. A bend controlling pressure sensitive valve opens in a supply line to a bending arm actuating piston arrangement when the pressure in a supply line to a former actuating piston arrangement reaches a predetermined value due to the former reaching its bending position. A return controlling pressure sensitive arrangement causes the motions of the piston arrangements to be reversed hydraulically when the pressure in a main supply line reaches a predetermined value due to the bending arm reaching a predetermined maximum bend position, whereby to return the former and bending arm to their initial positions.

BRIEF DESCRIPTION OF DRAWINGS

The invention will be described further, by way of example, with reference to the accompanying diagrammatical drawings, wherein.

DESCRIPTION OF SPECIFIC EMBODIMENTS

Figure 1:
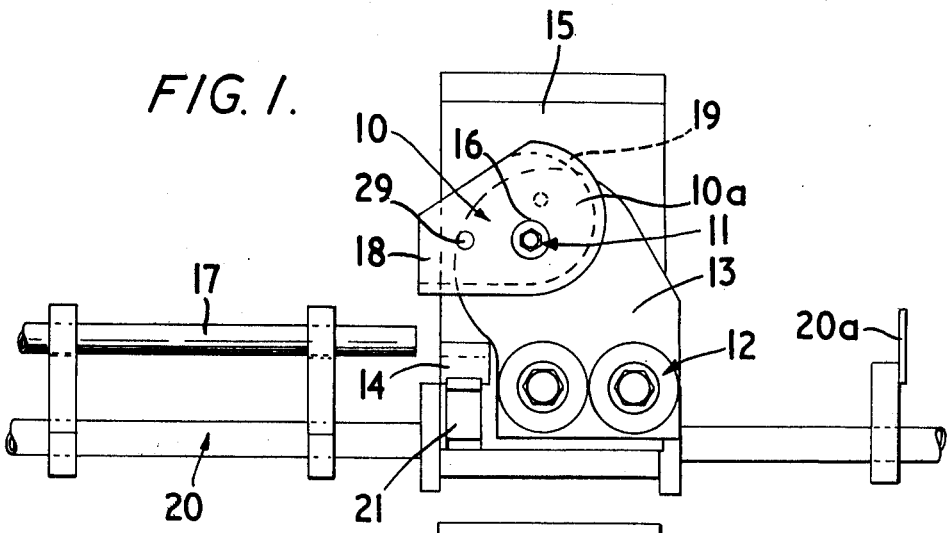
FIG. 1 shows a bending unit, of a bending machine of the invention, in an open condition to receive a workpiece.
Figure 2:
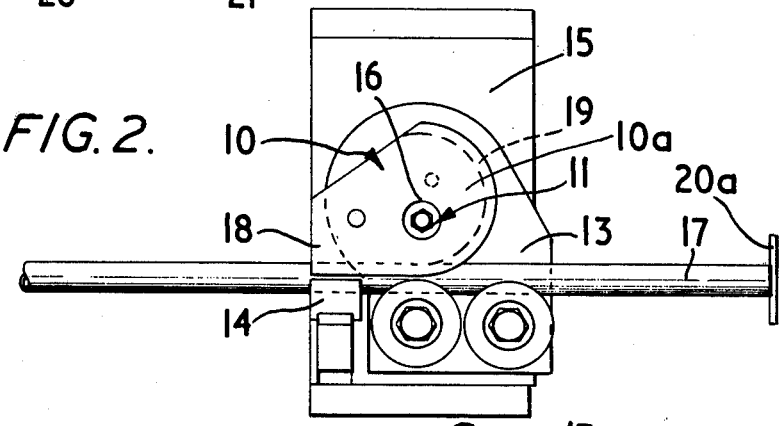
FIG. 2 is similar to FIG. 1 but shows the unit in a condition ready to bend the workpiece.
Figure 3:
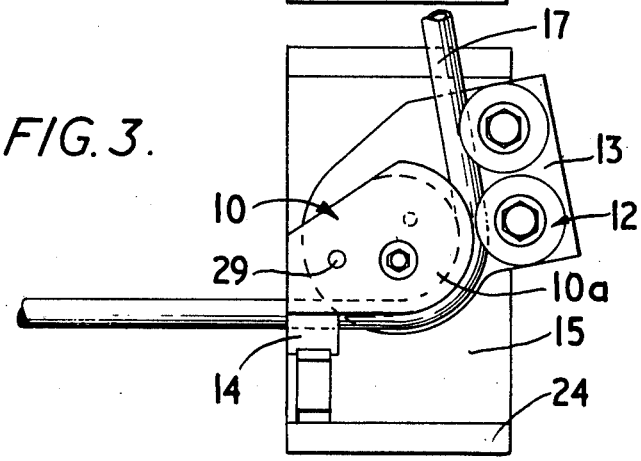
FIG. 3 is similar to FIGS. 1 and 2 but shows the unit in a condition wherein the workpiece has just been bent.

Referring to FIGS. 1 to 3, the bending unit comprises a former device 10 carried by an eccentric 11, a bending tool 12 carried by a bending arm 13, a clamp member 14 carried by a casing 15 of the unit, and an actuating mechanism hereinafter described.

The eccentric 11 is arcuately movable, by former drive means of said actuating mechanism, about an axis 16 so as to move the former device 10 between an open position (FIG. 1) and a bending position (FIGS. 2 and 3). In the open position the former device 10 is disposed such that it is spaced apart from the member 14 and tool 12 to permit a workpiece 17 to be fed therebetween to rest on the member 14 and tool 12.

In the bending position shown in FIG. 2, the former device 10 is disposed such that a workpiece 17 is clamped between the clamp member 14 and clamping extension 18 of the former device 10. Furthermore, former device 10 includes an integral curved former 10*a* which is proximal to the tool and is disposed such that the axis of its curved bending surface 19 is coincident with the axis 16.

The axis 16 is fixed and the bending arm 13 is rotatable about this axis, by arm drive means of the actuating mechanism, to move the tool 12 between a preselected presettable maximum bend position shown in FIG. 3 and an original position shown in FIGS. 1 and 2.

Referring to FIG. 1, a workpiece support assembly 20 is secured to the casing 15 and to an adjustable bracket 21 which locates the clamp member 14. Assembly 20 has an adjustable stop 20*a* so as to locate the workstock or workpiece 17 correctly with respect to the bending unit. The stop 20*a* serves to prevent the workpiece being moved linearly by the former device 10 as the latter approaches the clamping position.

Figure 4:
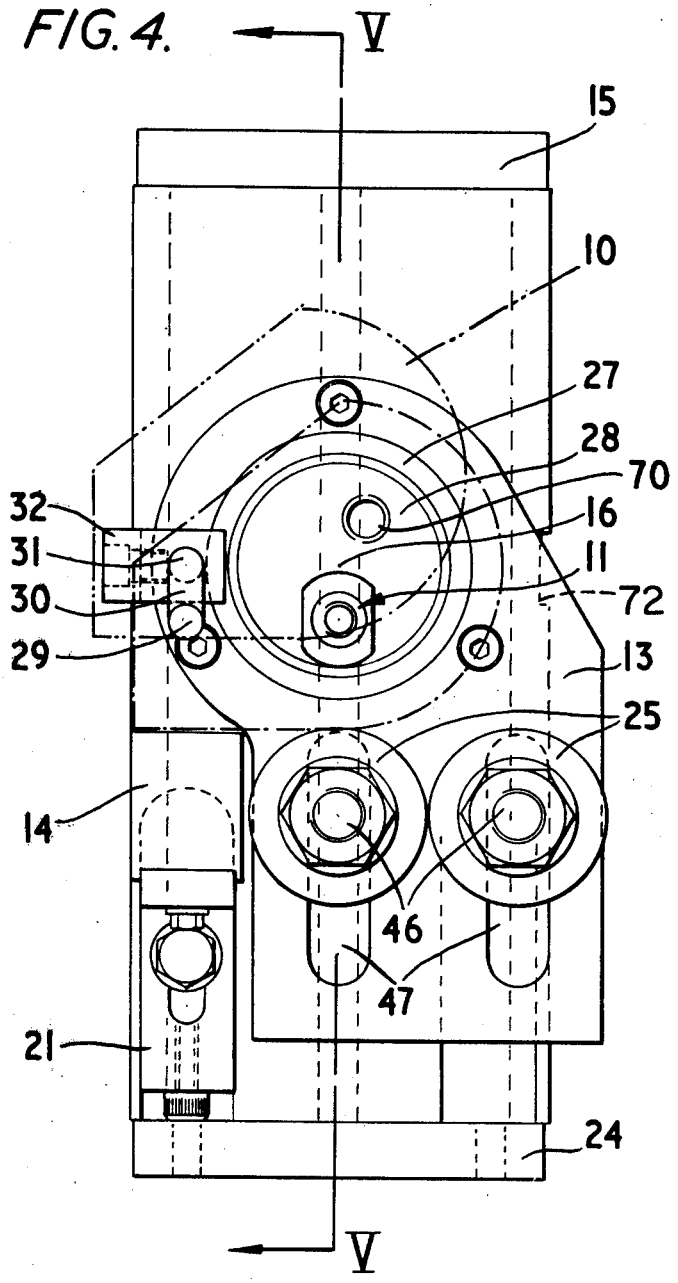
FIG. 4 shows the bending unit in enlarged front elevation.
Figure 5:
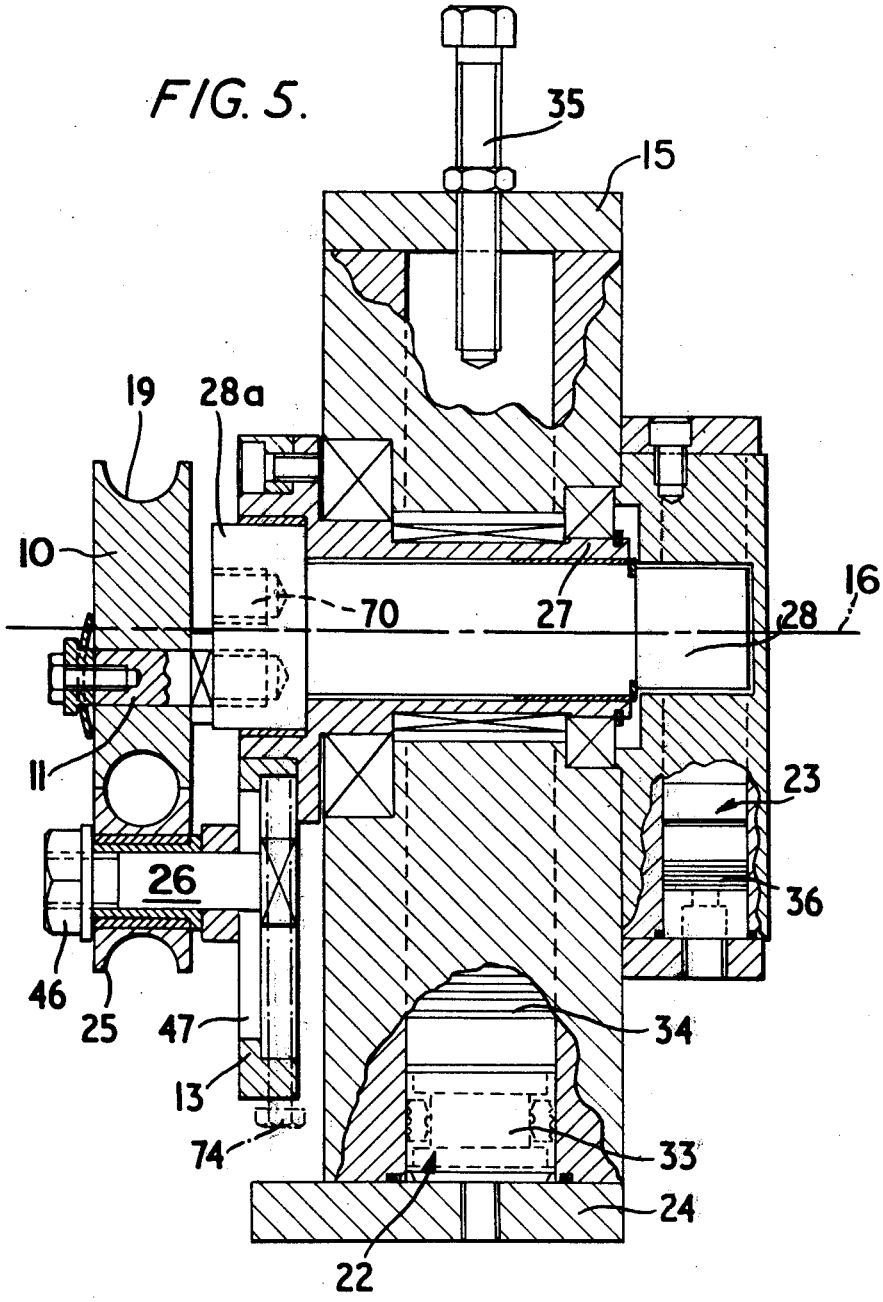
FIG. 5 shows the bending unit in partial cross-section corresponding to the line V–V in FIG. 4.

Referring to FIGS. 4 and 5, the casing 15 is built up from bolted together plate members and houses a bending arm actuating piston arrangement 22 of the arm drive means and a former actuating piston arrangement 23 of the former drive means. Casing 15 is bolted or otherwise secured to a main frame (not shown here) of the machine by means of its base 24, as hereinafter described.

The tool 12 comprises, in this embodiment, a pair of rollers 25 mounted on stub axles 26, which axles are secured adjustably to the bending arm 13. The bending arm 13 is secured to one end of a hollow shaft 27 which is journalled within the casing 15 so as to be rotatable by the piston arrangement 22 about the axis 16.

The eccentric 11 is secured to a headed end 28a of a further shaft 28, which shaft extends co-axially through the shaft 27 so as to be rotatable by the piston arrangement 23 to move the eccentric 11 in an arc about the axis 16 of the shaft. The former device 10 is journalled upon the eccentric 11, and also upon a peg 29 (FIG. 4) of a linkage which further controls the movement of the former device so that a lower surface of the extension 18 remains parallel to an upper surface of the clamp member 14 as indicated in broken lines in FIG. 4. The peg 29 forms part of a crank 30 having a pin 31 pivotally supported by a bracket 32. Bracket 32 is bolted to the casing 15 and extends between the bending arm 13 and the former device 10. The longitudinal axes of the shaft 28, eccentric 11, peg 29 and pin 31 are all parallel so that a line joining said axes in a plane normal thereto forms a parallelogram.

The former device 10 is held on the eccentric 11 by a bolt, bush and spring washer, the latter providing sufficient friction to make the linkage follow the movement of the eccentric 11 due to the torque imparted to the former device 10.

The piston arrangement 22 comprises a return piston 33 secured to a rack 34 which acts on one side of the shaft 27, and a similar advance piston and rack (not shown here) which act on the other side of the shaft 27. The stroke of the piston 33 can be limited by an adjustable stop 35 (FIG. 5), and a similar stop is provided for the advance piston.

The piston arrangement 23 is similar to the piston arrangement 22 except in that it is smaller and the strokes of its advance piston 36 and return piston (not shown here) are limited by fixed stops (not shown here), or by the casing itself.

Figure 6:
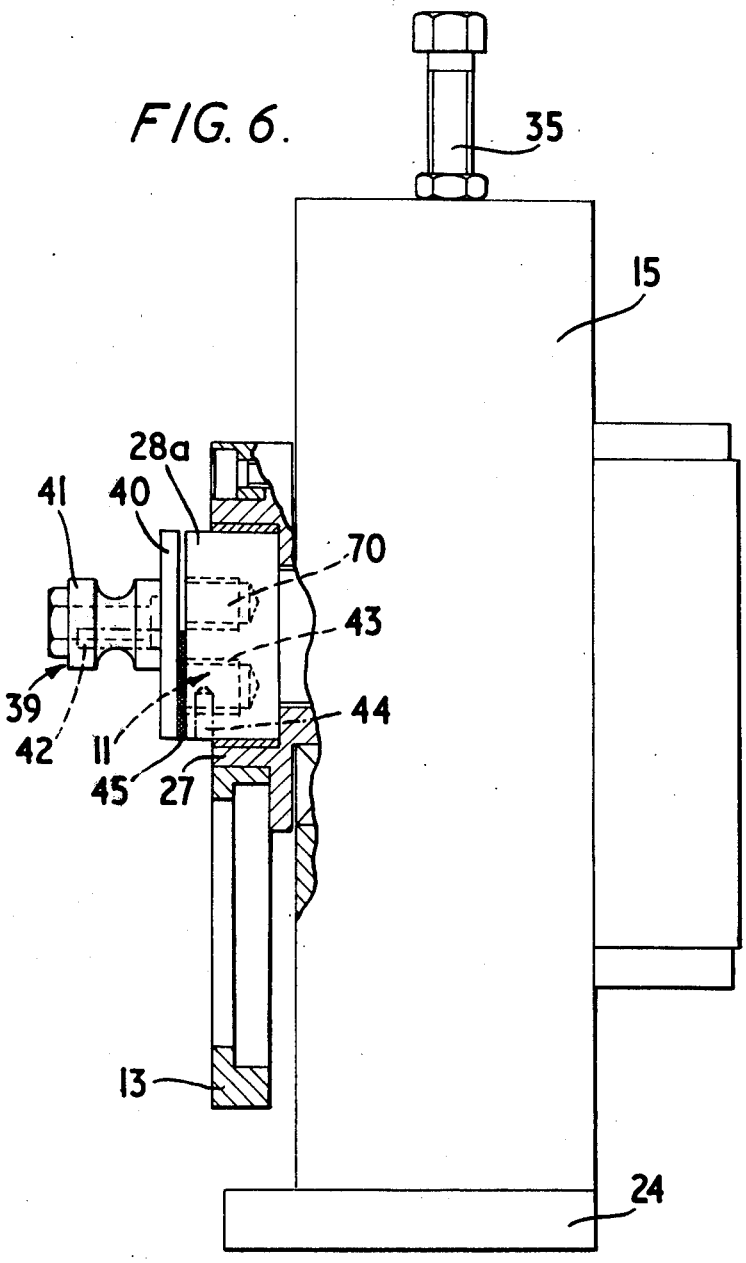
FIG. 6 shows part of the bending unit in side elevation with a modified former device.

As shown in FIG. 6 the bending unit may have an alternative former device 39 of non-integral form. The example shown is designed for forming small radius bends. In this example, the former device 39 comprises a plate 40 having secured thereon a former 41 and a clamping extension 42 (shown in broken lines). The eccentric 11 is welded to the plate 40 and is annularly grooved so as to be retainable in a bush 43 in the headed end 28*a* by means of a pin 44 for rotation relative to headed end 28a. A friction pad 45 is provided to apply torque to the former device. In both kinds of former device 10, 39 the axis of bending is coincident with or very close to the axis of the shafts 27, 28 to obviate or minimize non-rotative movement of the tool relative to the bending arm 13.

Furthermore, the tool 12 is adjustably located on the bending arm 13 to co-operate with different sizes of formers 10*a*, 41, by means of bolts 46 and ways 47.

The actuating mechanism of the machine is provided with an electro-hydraulic system (FIG. 7) to operate the bending unit, which system comprises a reservoir 50, a pump 51 which supplies hydraulic fluid to the piston arrangements 22, 23 via a main supply line 52 and individual supply lines 53, 54 controlled by valve arrangements (hereinafter described), and manually actuable electrical controls (hereinafter described).

The system is arranged such that the bending unit starts and finishes each bending cycle in the condition shown in FIG. 1. At the start of a bending cycle, a starting control switch 55 is actuated manually to start a motor 56. Consequently, fluid is fed from the pump 51 via the main supply line 52 to a solenoid operated reversing valve 57. Valve 57 is held in an advanced condition, by an advance solenoid 58 thereby connecting lines 53 and 54 to the advance pistons 36 and 59, respectively, to the main supply line 52. In the advance condition, the valve 57 connects a dump line 60 terminating at the reservoir 50 to a common return line 61 from the return pistons 33 and 62. Until the advance piston 36 has reached the limit of its stroke to bring the former device to its bending position, a presettable bend controlling pressure sensitive valve 63, remains closed in the line 54 to the advance piston 59 of the piston arrangement 22. However, when said limit is reached, the hydraulic pressure in the lines 52, 53 increases to open this valve 63 to supply fluid to the advance piston 59, whereby to cause the bending arm 13 to move to the maximum bend condition shown in FIGS. 3 and 7. In this condition the advance piston 59 has reached the limit set by the adjustable stop 35*a*. Thus, pressure further increases in the main supply line 52 to open a presettable dump valve 64 to pass fluid to the reservoir 50*a* via a restriction 64*a*. This action is sensed by a sensor 65 to actuate a return switch 66 of an electrical control arrangement 67, which de-energizes the solenoid 58 and energizes a return solenoid 68. Consequently, the reversing valve 58 switches to a return condition wherein the return line 61 is connected to the main supply line 52 to return the former and bending arm to the original condition shown in FIG. 1. In the return condition the dump line 60 is connected to the lines 53 and 54 so that fluid can flow (via non-return valve 69 from line 54) to the reservoir 50. When the original condition is reached a second actuation of switch 66 shuts down the system.

The emergency stop switch 55*a* is provided to cause the control arrangement 67 to halt the bending cycle and to return the bending unit directly to the initial condition.

The bending unit is hereinbefore described as arranged to clamp and bend by rotation of the parts in an anticlockwise direction as viewed from the front, but it is adapted to be set up to clamp or to bend in the opposite direction. The head end 28*a* of the shaft 28 is provided with an alternative socket 70 (FIGS. 4 to 7) for the eccentric 11 so that it may be repositioned some 120°, in an anti-clockwise direction, away from the position indicated. A reverse action valve 71 (FIG. 7) is provided in the lines 53 and 61 to the former actuating piston arrangement 23 whereby to reverse the functions of the pistons 36, 62. A further locating recess 72 (FIG. 4) for the linkage 31 is provided on the casing 15, and the former device 10, clamp member 14, bracket 21 and assembly 20 are all suitable as shown for being repositioned to suit clockwise clamping. Similarly the lines 54, 61 to the piston arrangement 22 can be reversed by a valve 73 and the arrangement for mounting the tool 12 on the bending arm 13 can be modified to permit the latter to be reversed for clockwise bending, e.g. by using a reversible bending arm having screw locators (one of which is indicated at 74 in FIG. 5) for positioning the tool. In such a disposition the stop 35*a* is withdrawn and the stop 35 becomes operative.

The illustrated movement of the former device is particularly useful where two or more units are employed as it enables the units to be arranged freely, because it automatically provides ample clearance for removal of the bent workpiece, provided that adjacent former devices do not move away from each other after making adjacent bends simultaneously.

FIGS. 8 to 12 show examples of how several units may be provided in selectable positions on a bending machine frame or body 75 (indicated in FIG. 11), and operated by having the individual supply lines ganged for operation in unison or in sequence as required.

Figure 11:
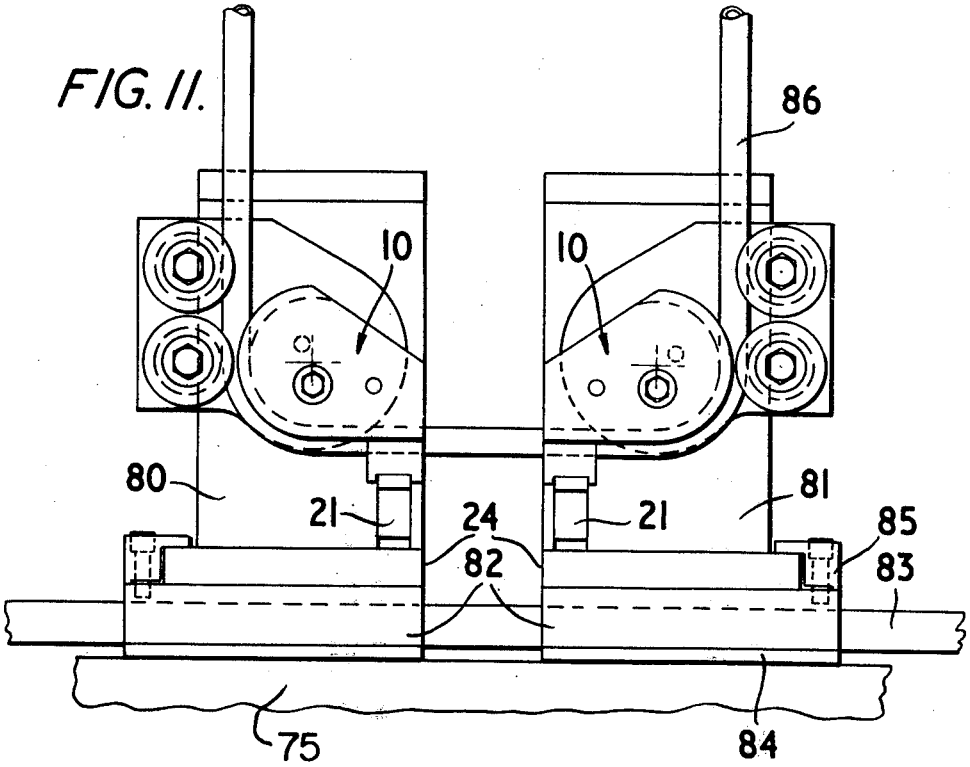
FIG. 11 shows in front elevation an upper portion of a bending machine incorporating two of the bending units in a forwards facing condition.
Figure 12:
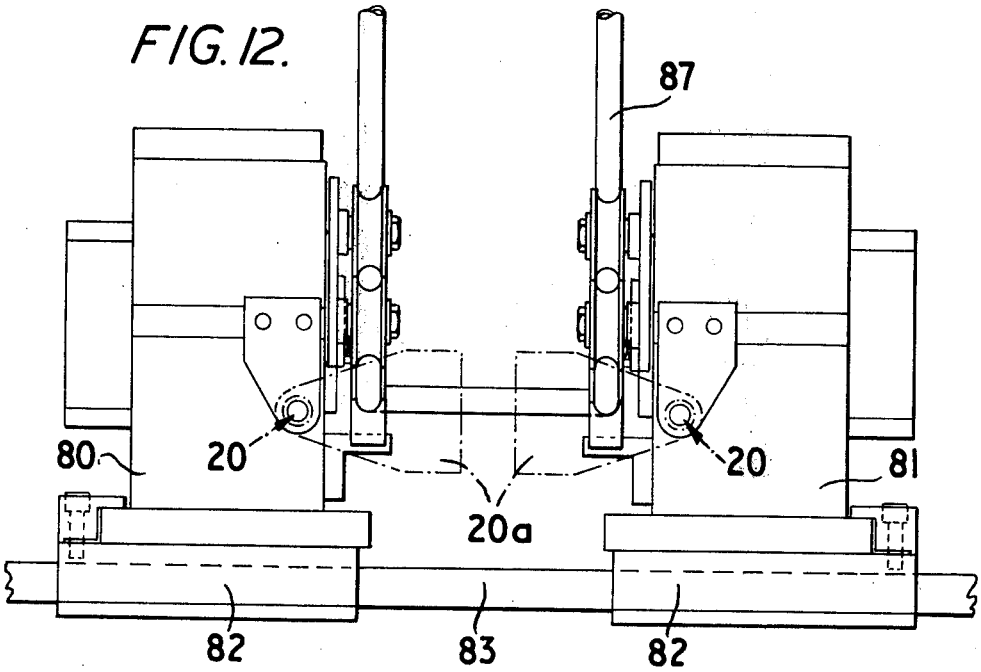
FIG. 12 shows part of said machine in front elevation with the bending units turned to confront each other to appear in side elevation.

The units 80 and 81 shown in FIGS. 11 and 12 are substantially identical to those hereinbefore described except in that the bases 24 are mounted on turntable slides 82 which are in turn slidably mounted on a slide rail 83 of the machine frame or body 75. Each slide 82 has a bottom member 84 by means of which it can be securely held on the rail 83 during bending, and a base clamp 85 to secure the unit in a selected position. The units 80 and 81 are arranged respectively for clockwise and anticlockwise clamping and bending so that a workpiece 86 can be bent to U-shape in a single bending cycle by simultaneous operation of the units, as indicated in FIG. 11. The units 80, 81 can be linearly and angularly repositioned in mutual confrontation as shown in FIG. 12 (or in another desired relationship) to make further bends e.g. to make a seat and back subframe 87 or a perambulator handle, the appropriate stops 20*a* being moved with the units. The system shown in FIG. 7 is used with both units connected to the lines 53, 54 and 61.

Further units may be provided on the machine.

Figure 8:
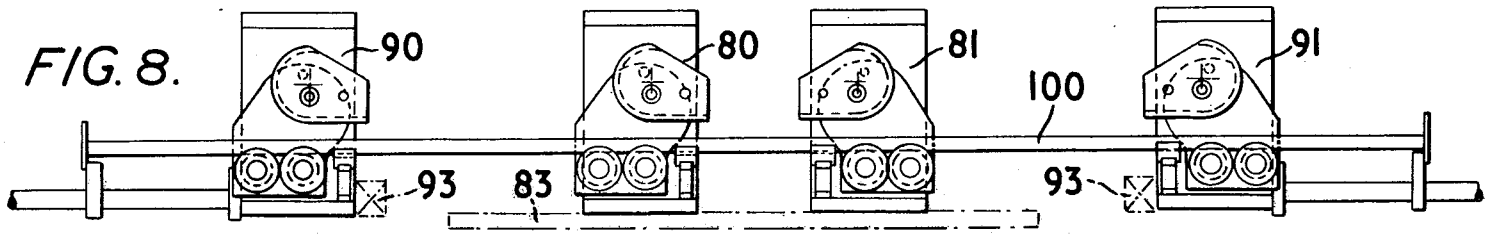
FIGS. 8, 9 and 10 show four of the bending units in three of a sequence of positions involved in bending a workpiece.
Figure 9:
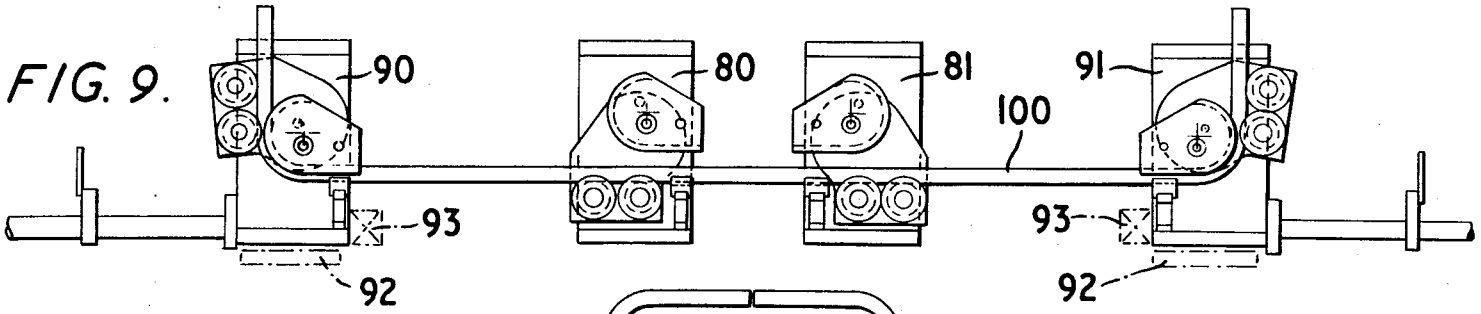
Figure 10:
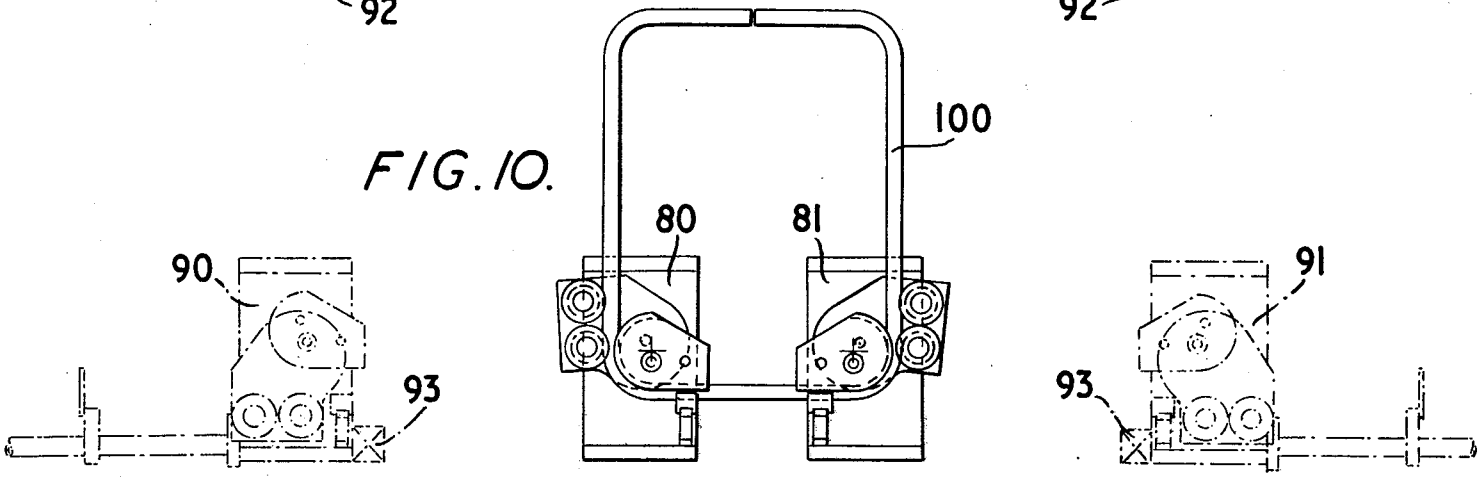

FIGS. 8 to 10 show two such further units 90 and 91 with the units 80, 81 therebetween. The units 90, 91 are each mounted on a respective slide rail 92 (FIG. 9) which slide rails 92 extend transversely to the slide rail 83 (FIG. 8) to enable the units 90, 91 to be moved forwards and rearwards by a respective ram 93.

Figure 7:
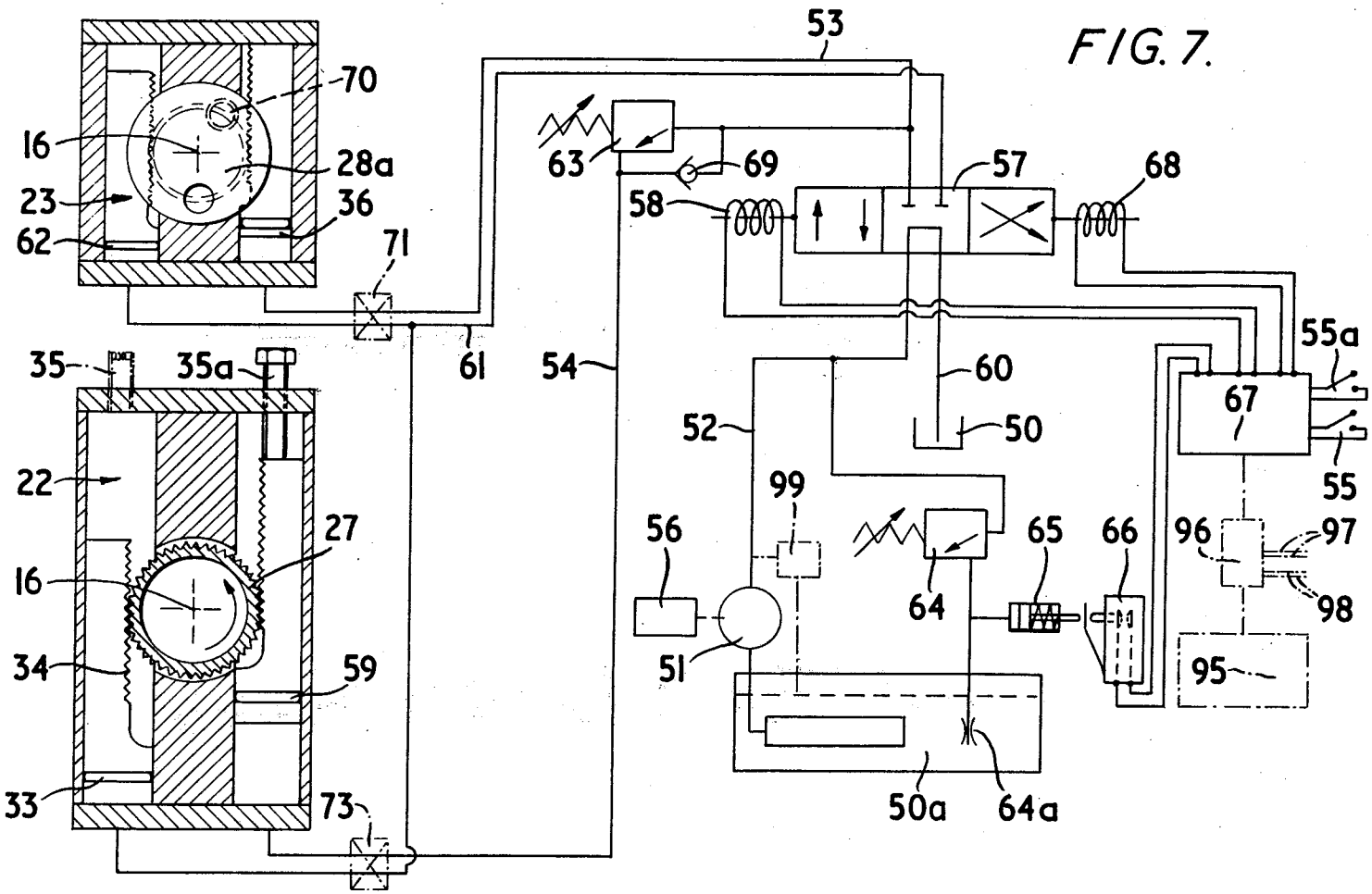
FIG. 7 is an electro-hydraulic circuit diagram of the actuating mechanism of the bending unit.

The units 90 and 91 are served by a further electro-hydraulic control system duplicating that serving the units 80 and 81, the electrical control arrangement 67 for the units 80 and 81 being linked to the similar arrangement 95 for the units 90, 91 by an interlock and timing device 96 as indicated in FIG. 7. The device 96 has control lines 97 for the rams 93, and lines 98 to control a pressure limiting valve 99 inserted into the line 52 to the units 80 and 81.

The arrangement is such that the cycle for bending a tube 100 to rectangular form commences by bending the end portions of the tube by the units 90, 91 (FIG. 9) until the switch 66 of their system closes whereupon the device 96 intervenes in the cycle to inhibit return of the units 90, 91 until the tube is clamped by the units 80, 81. To this end the device 96 closes the circuit of switch 55 of the units 80, 81 but actuates valve 99 to limit the pressure in the line 52 to less than that required to open valve 63. After an interval for clamping, the units 90, 91 are permitted to return to their initial positions thereby releasing the tube and again actuating their switch 66 to cause the device 96 to actuate the rams 93 to retract the units 90, 91. After an interval for retraction, the device 96 closes the valve 99 to permit the normal operation of the units 80, 81 to continue to completion.

The invention is not confined to the details of the foregoing examples, and the scope of the invention as defined by the appended claims includes various alternatives. For example the shafts may be actuated manually by physical effort, or by electrical or pneumatic motors, but hydraulic operation is preferred.

I claim:

1. A bending unit comprising:
   a. a former device;
   b. bending means disposed on a rotatably mounted bending arm means;
   c. a clamp member;
   d. means for rotating the bending arm means about a fixed axis;
   e. carrier shaft means disposed coaxially with said fixed axis; and
   f. means connecting the former device to the carrier shaft to move the former device between an open position and a bending position;
   g. in the open position said former device being spaced apart from the bending means by an amount sufficient to allow movement of a workpiece therebetween;
   h. in the bending position said former device being effective to thrust a workpiece against the bending means and clamp member.

2. A bending unit as defined in claim 1 wherein actuating means is effective to cause the rotating means to pivot the bending arm about the fixed axis when the former device is in the bending position.

3. A bending unit as defined in claim 2 wherein said actuating means includes a hydraulic circuit wherein a bend controlling pressure sensitive valve opens in a supply line to a bending arm actuating piston arrangement when the pressure in a supply line to a former actuating piston arrangement reaches a predetermined value due to the former reaching its bending position, and wherein a return controlling pressure sensitive arrangement causes the motions of the piston arrangements to be reversed hydraulically when the pressure in a main supply line reaches a predetermined value due to the bending arm reaching a predetermined maximum bend position, whereby to return the former and the bending arm to their initial positions.

4. A bending unit as defined in claim 1 wherein a stop means prevents linear movement of a workpiece as the former device moves from the open position to the bending position.

5. A bending unit as defined in claim 4 wherein the stop means is mounted on a casing of the unit or on a workrest.

6. A bending unit as defined in claim 1 wherein the clamp member is adjustably mounted on the bending unit.

7. A bending unit as defined in claim 1 wherein the former device, bending arm, bending arm rotating means, and former device connecting means are adapted to operate for clamping and bending a workpiece in either a clockwise or anticlockwise direction.

8. A bending unit as defined in claim 1 wherein a linkage is provided to control the movement of the former device so that the former device is constrained to move bodily in a curved path without significant rotation about said fixed axis.

9. A bending unit as defined in claim 1 wherein said bending arm rotating means includes a hollow shaft means rotatably, coaxially disposed around the carrier shaft means, said bending arm being carried by said hollow shaft means.

10. A bending unit as defined in claim 9 wherein said hollow shaft means and said carrier shaft means being driven by racks and pistons.

11. A bending unit as defined in claim 1 wherein the former device connecting means includes eccentric means connecting the former device at the end of the carrier shaft means.

12. A bending unit as defined in claim 11 wherein the eccentric means includes a pin member securable in alternative sockets located in the carrier shaft means.

13. A plurality of bending units as defined in claim 1 wherein said units are mounted for selective positioning on a frame structure and being effective to work on a common workpiece either sequentially or in unison.

14. A plurality of bending units as defined in claim 13 wherein at least one of the units is rotatively mounted on lockable turntables.

15. A plurality of bending units as defined in claim 13 wherein at least one of the units is mounted on rail means.

16. A plurality of bending units as defined in claim 13 wherein mechanical drive means is effective to move at least one of the units to a selected position on the frame structure.

* * * * *